US009188343B2

(12) United States Patent
Cadima et al.

(10) Patent No.: US 9,188,343 B2
(45) Date of Patent: Nov. 17, 2015

(54) OVEN APPLIANCE AND A GAS BURNER ASSEMBLY FOR THE SAME

(71) Applicant: General Electric Company, Schenectady, NY (US)

(72) Inventors: Paul Bryan Cadima, Prospect, KY (US); Bai Han, Chadds Ford, PA (US); Gonzalo Luis Ocano, Louisville, KY (US)

(73) Assignee: General Electric Company, Schenectady, NY (US)

( * ) Notice: Subject to any disclaimer, the term of this patent is extended or adjusted under 35 U.S.C. 154(b) by 352 days.

(21) Appl. No.: 13/741,605

(22) Filed: Jan. 15, 2013

(65) Prior Publication Data

US 2014/0196712 A1 Jul. 17, 2014

(51) Int. Cl.

| | |
|---|---|
| ***F23D 14/10*** | (2006.01) |
| ***F24C 3/10*** | (2006.01) |
| ***F24C 3/08*** | (2006.01) |

(52) U.S. Cl.

CPC . *F24C 3/10* (2013.01); *F23D 14/10* (2013.01); *F24C 3/087* (2013.01)

(58) Field of Classification Search

CPC . A47J 37/067; A47J 37/0676; A47J 37/0682; A47J 37/0688; A47J 37/0694; F24C 3/10; F24C 3/087; F24C 3/085; F23D 14/06; F23D 14/08; F23D 14/10; F23D 14/105

USPC ..... 126/1 R, 39 E, 92 B, 92 R; 431/150, 431/170–181, 328, 329, 347, 352, 353

See application file for complete search history.

(56) References Cited

U.S. PATENT DOCUMENTS

| | | | | |
|---|---|---|---|---|
| 941,708 | A * | 11/1909 | Geurink | 431/249 |
| 3,422,810 | A * | 1/1969 | Weiss | 126/41 R |
| 4,628,897 | A | 12/1986 | Stanfa et al. | |
| 6,102,029 | A * | 8/2000 | Stephen et al. | 126/41 R |
| 6,553,986 | B1 * | 4/2003 | Liu | 126/41 R |
| 6,705,307 | B2 * | 3/2004 | Alden et al. | 126/41 R |
| 2009/0250049 | A1 * | 10/2009 | Tseng | 126/39 E |
| 2011/0186038 | A1 | 8/2011 | Kim et al. | |

FOREIGN PATENT DOCUMENTS

| | | |
|---|---|---|
| GB | 482482 | 3/1938 |

* cited by examiner

*Primary Examiner* — Avinash Savani
(74) *Attorney, Agent, or Firm* — Dority & Manning, P.A.

(57) ABSTRACT

A gas burner assembly for an oven appliance is provided. The gas burner assembly includes a pair of burner tubes. A runner tube extends between and can fluidly connect the burner tubes of the pair of burner tubes. The runner tube can assist with carrying flames between the burner tubes of the pair of burner tubes.

16 Claims, 5 Drawing Sheets

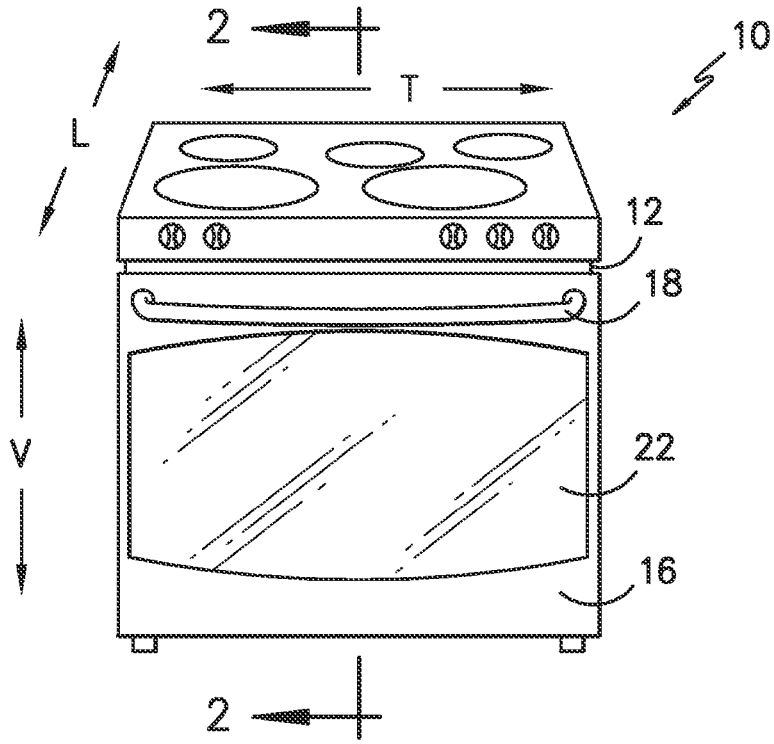
FIG. —1—
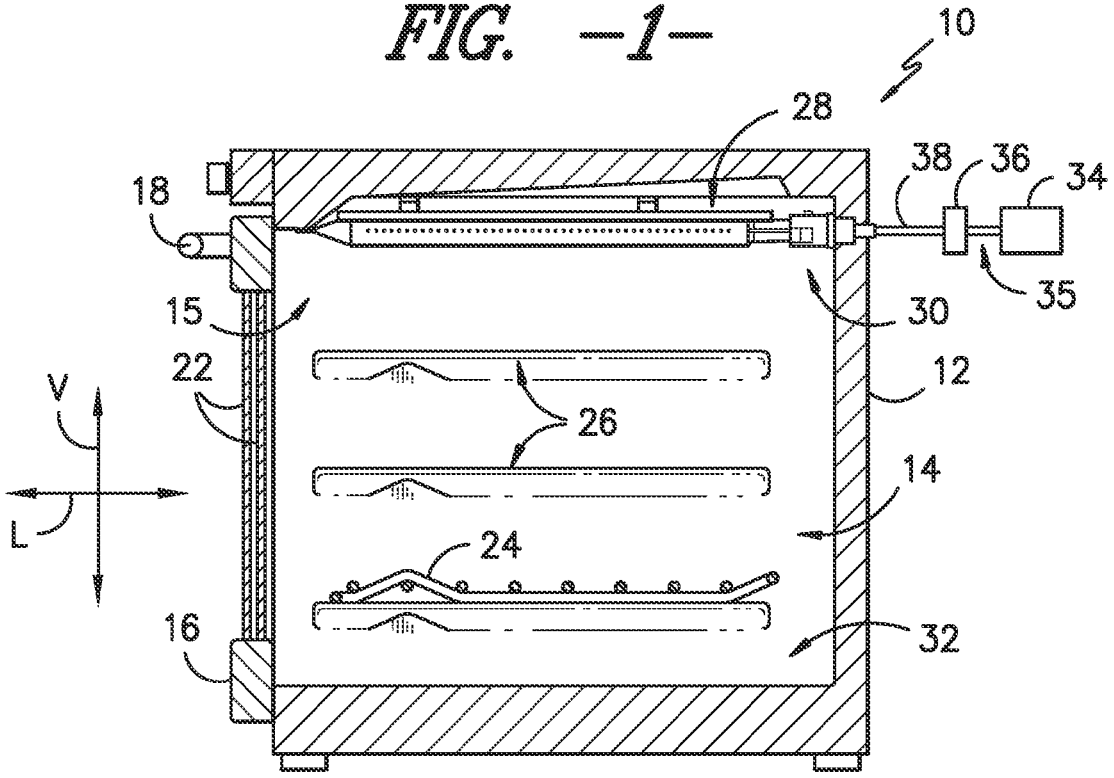
FIG. —2—

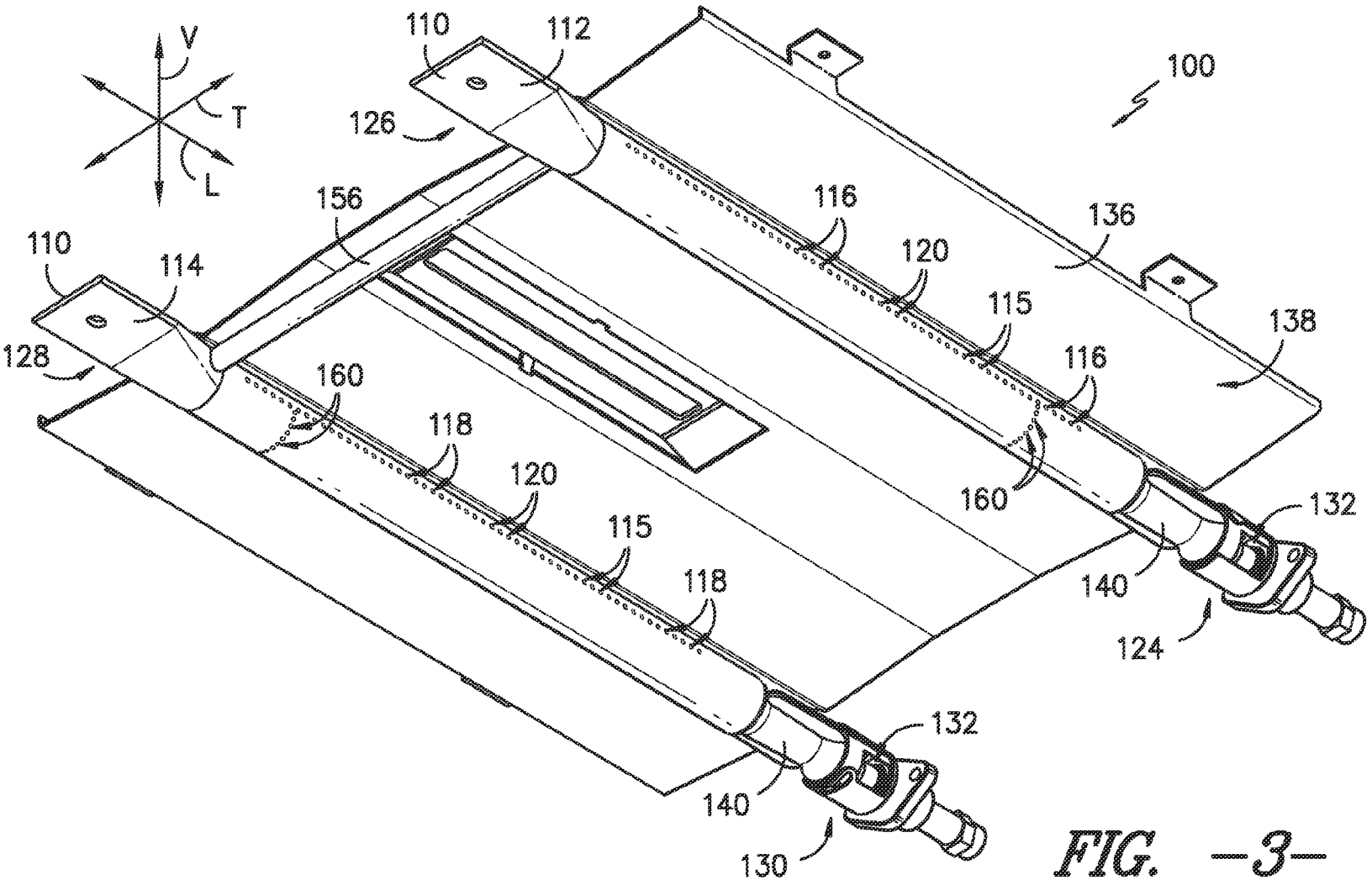
FIG. —3—

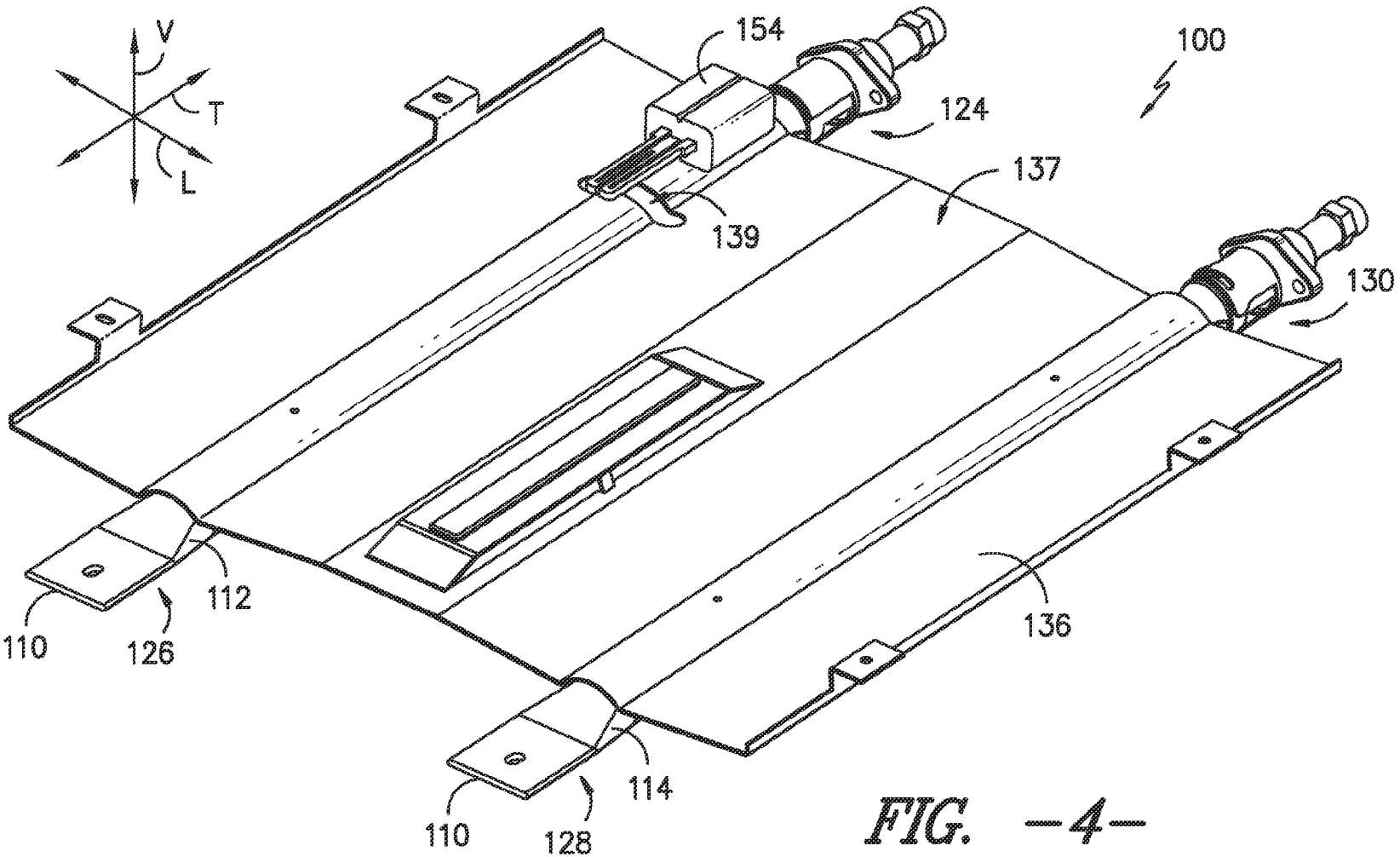
FIG. —4—

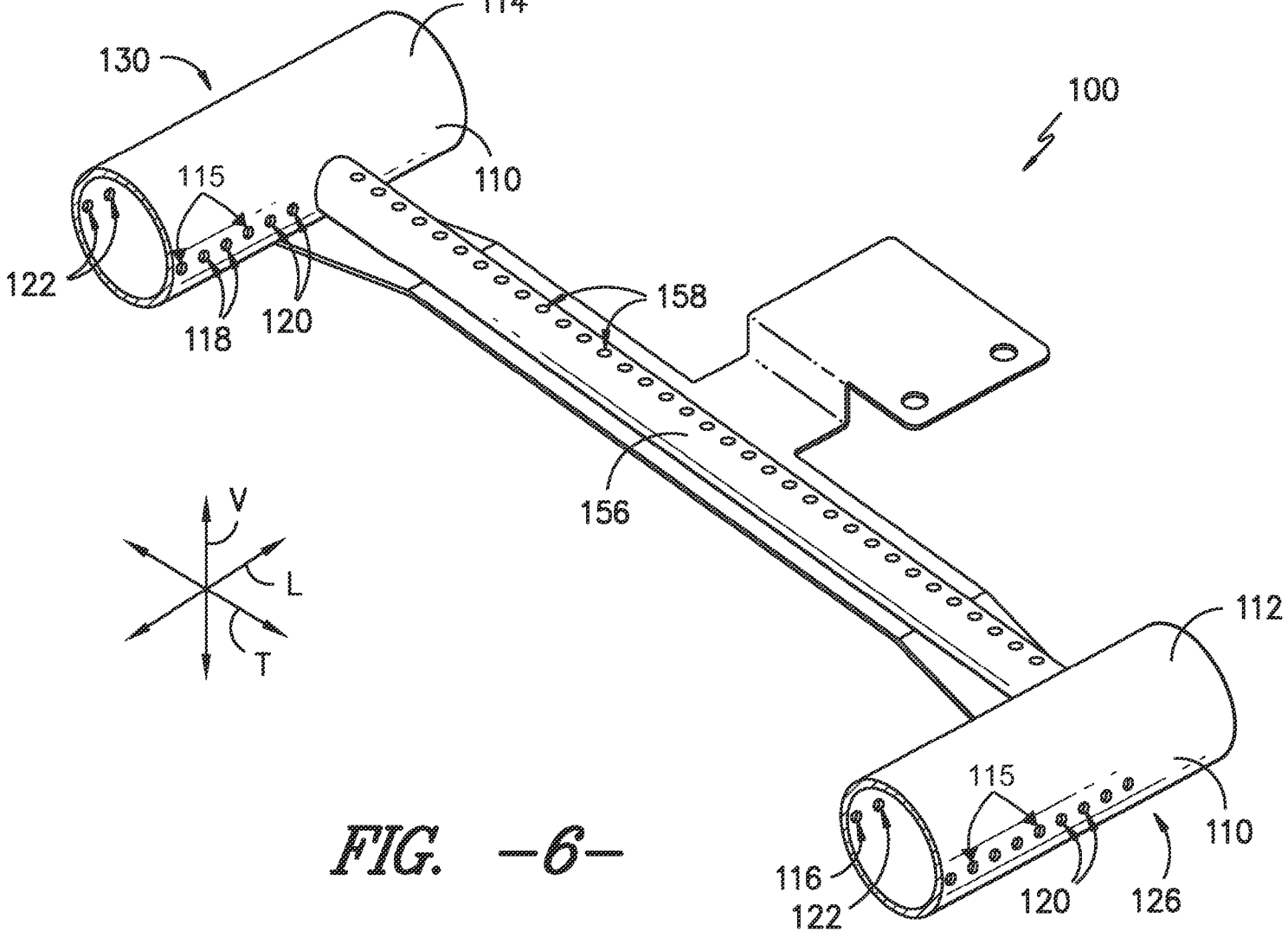
FIG. —6—

OVEN APPLIANCE AND A GAS BURNER ASSEMBLY FOR THE SAME

FIELD OF THE INVENTION

The present subject matter relates generally to oven appliances and gas burner assemblies for the same.

BACKGROUND OF THE INVENTION

Oven appliances generally include a cabinet that defines a cooking chamber for receipt of food items for cooking. Heating elements, such as gas burners, can be positioned within the cooking chamber to heat food items located therein. In certain oven appliances, a broil gas burner assembly is positioned at a top of the cooking chamber, and a bake gas burner assembly is positioned at a bottom of the cooking chamber. Broil gas burner assemblies can apply heat such that external surfaces of food items are seared without overcooking the interior of the food items. Thus, performance of a broil gas burner assembly can be measured by its ability to provide intense heat uniformly over a large area.

Certain oven appliances include broil gas burner assemblies having a single burner tube and a flame spreader positioned above the burner tube. The flame spreader can translate the convective heat of the burner tube's flames into radiant heat suitable for searing foods. Broil gas burner assemblies with a single burner tube can be inexpensive and easy to manufacture and/or prototype. However, the single burner tube is generally positioned down a center line of the oven appliance, and achieving intense heat uniformly in such a configuration can be difficult. In particular, food items positioned away from the oven appliance's center line can receive less heat intensity than those located relatively close to the oven appliance's center line because radiant heat intensity drops quickly with increasing distance from the broil gas burner assembly's flame spreader.

To avoid such drawbacks, certain oven appliances utilize non-tubular gas burners. Such non-tubular gas burners can distribute gaseous fuel over a larger effective area thereby spreading out the radiant energy generated by combustion of gaseous fuel over a larger area. However, such non-tubular gas burners can be costly to manufacture and prototype. Thus, such designs can have increased development times and thereby hamper modular use of such designs. Further, the relatively high cost of prototyping such designs can limit use of such designs on multiple oven sub-systems which may have different design needs.

In another approach, certain oven appliances include long burner tubes bent into various shapes to increase coverage of the oven appliances' broil heating assembly. This approach suffers from certain difficulties. In particular, outlet holes (ports) in gas burner assemblies are preferably consistent and uniform. In such designs, ports are generally punched in the long burner tubes prior to bending. However, once the long burner tubes are bent, the ports in the bent areas can deform. This can make port sizing in such regions difficult to control. Further, due to the excessively long lengths of such burner tubes, pressure gradients from fuel flowing through the burner tubes can create non-uniform flow out of the ports and uneven heating and burning of gaseous fuel can result.

Accordingly, an oven appliance having a broil gas burner assembly with features for providing intense heat uniformly over a large area would be useful. In particular, an oven appliance having a broil gas burner assembly with features for providing intense heat uniformly over a large area that is easy and inexpensive to produce would be useful.

BRIEF DESCRIPTION OF THE INVENTION

The present subject matter provides a gas burner assembly for an oven appliance. The gas burner assembly includes a pair of burner tubes. A runner tube extends between and can fluidly connect the burner tubes of the pair of burner tubes. The runner tube can assist with carrying flames between the burner tubes of the pair of burner tubes. Aspects and advantages of the invention will be set forth in part in the following description, or may be apparent from the description, or may be learned through practice of the invention.

In a first exemplary embodiment, an oven appliance is provided. The oven appliance defines a vertical direction, a lateral direction, and a transverse direction. The vertical, lateral, and transverse directions are mutually perpendicular. The oven appliance includes a cabinet that defines a cooking chamber for receipt of food items for cooking. The cooking chamber of the cabinet extends between a top portion and a bottom portion along the vertical direction. A broil gas burner assembly is positioned at the top portion of the cooking chamber. The broil gas burner assembly includes a first burner tube that extends between a first end portion and a second end portion along the lateral direction. The first burner tube defines a series of outlets dispersed along the lateral direction between the first end portion of the first burner tube and the second end portion of the first burner tube. A second burner tube is spaced apart from the first burner tube along the transverse direction. The second burner tube extends between a first end portion and a second end portion along the lateral direction. The second burner tube defines a series of exits dispersed along the lateral direction between the first end portion of the second burner tube and the second end portion of the second burner tube. A runner tube extends between the first burner tube and the second burner tube along the transverse direction. The runner tube defines a series of openings distributed along the transverse direction between the first and second burner tubes.

In a second exemplary embodiment, an oven appliance is provided. The oven appliance defines a vertical direction, a lateral direction, and a transverse direction. The vertical, lateral, and transverse directions are mutually perpendicular. The oven appliance includes a cabinet that defines a cooking chamber for receipt of food items for cooking. The cooking chamber of the cabinet extends between a top portion and a bottom portion along the vertical direction. A pair of burner tubes is positioned at the top portion of the cooking chamber. The burner tubes of the pair of burner tubes are spaced apart from each other along the transverse direction. Each burner tube of the pair of burner tubes defines a series of laterally spaced apart ports. A runner tube extends between and fluidly connects the burner tubes of the pair of burner tubes. The runner tube defines a series of transversely spaced apart openings. The runner tube is configured for carrying flames between the burner tubes of the pair of burner tubes.

In a third exemplary embodiment, a gas burner assembly for an oven appliance is provided. The gas burner assembly defines a vertical direction, a lateral direction, and a transverse direction. The vertical, lateral, and transverse directions are mutually perpendicular. The gas burner assembly includes a pair of burner tubes spaced apart from each other along the transverse direction. Each burner tube of the pair of burner tubes defines a series of laterally spaced apart ports. Each burner tube of the pair of burner tubes also defines an inlet. The gas burner assembly also includes a pair of orifices.

Each orifice of the pair of orifices is positioned at a respective inlet of the pair of burner tubes and is configured for directing a flow of gaseous fuel into the respective inlet of the pair of burner tubes. A valve is configured for regulating the flow of gaseous fuel to the pair of orifices. A runner tube extends between and fluidly connects the burner tubes of the pair of burner tubes. The runner tube defines a series of transversely spaced apart openings. The runner tube is configured for carrying flames between the burner tubes of the pair of burner tubes.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

FIG. 1 provides a perspective view of an oven range appliance according to an exemplary embodiment of the present subject matter.

FIG. 2 provides a section view of the oven range appliance of FIG. 1 taken along the 2-2 line of FIG. 1.

FIG. 3 provides a bottom, perspective view of a broil gas burner assembly according to an exemplary embodiment of the present subject matter.

FIG. 4 provides a top, perspective view of the broil gas burner assembly of FIG. 3.

FIG. 6 provides a partial, perspective view of the broil gas burner assembly of FIG. 3.

DETAILED DESCRIPTION OF THE INVENTION

Figure 5:
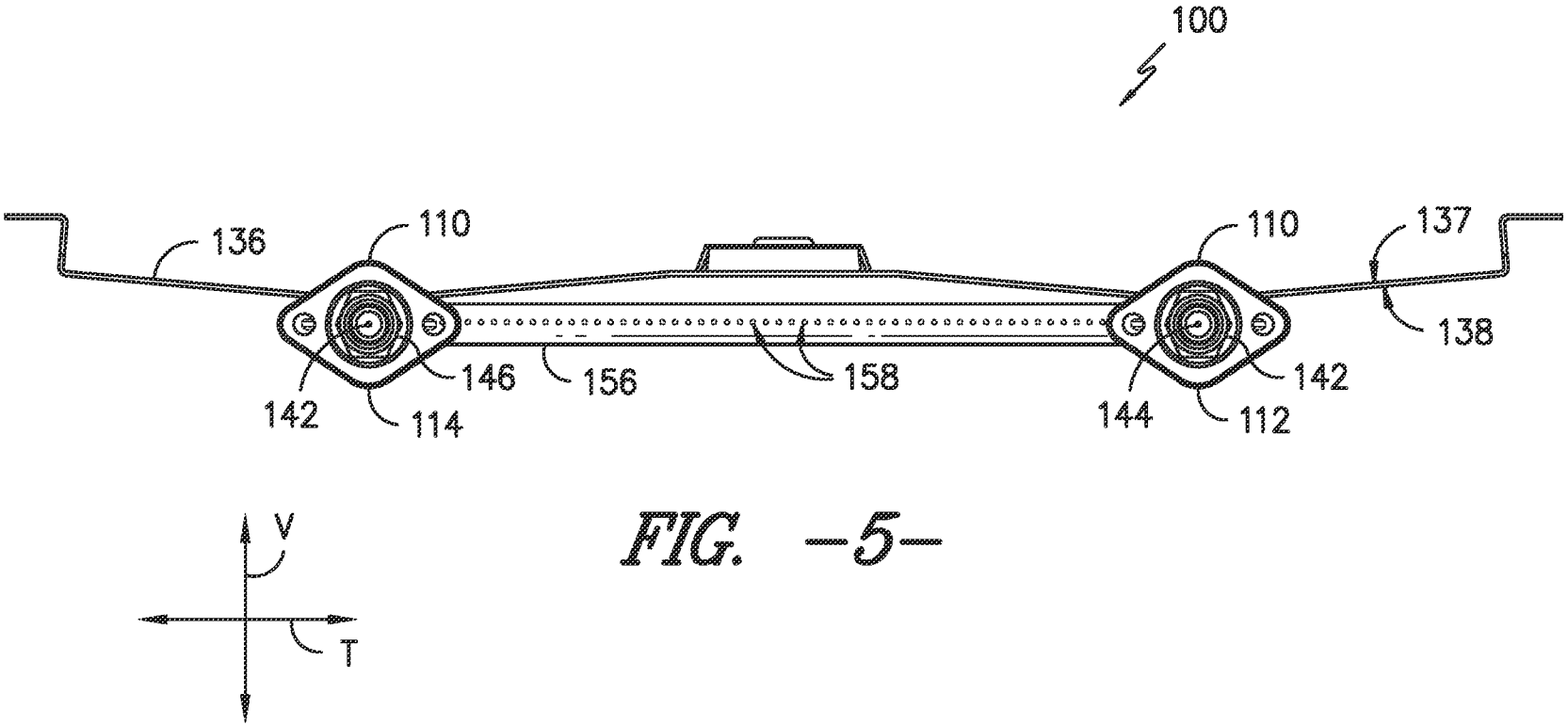
FIG. 5 provides a side, elevation view of the broil gas burner assembly of FIG. 3.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of an oven range appliance 10 according to an exemplary embodiment of the present subject matter. FIG. 2 provides a section view of oven range appliance 10 taken along the 2-2 line of FIG. 1. Oven range appliance 10 shown in FIGS. 1 and 2 is provided by way of example only. Thus, as will be understood by those skilled in the art, the present subject matter may be used with other oven appliance configurations, such as wall oven appliances or stand-alone oven appliances. In addition, the present subject matter may be used with oven appliances that define multiple interior cavities for the receipt of food and/or having different pan or rack arrangements than what is shown in FIG. 2. Still other configurations may also be used as will be understood by one of skill in the art using the teachings disclosed herein.

Oven range appliance 10 defines a vertical direction V, a lateral direction L, and a transverse direction T. The vertical direction V, lateral direction L, and transverse direction T are mutually perpendicular and form an orthogonal direction system. It should be understood that the orientation of the lateral direction L and transverse direction T shown in FIGS. 1 and 2 is provided by way of example only. Thus, in alternative exemplary embodiments, the transverse direction T and lateral direction L may be switch or inverted relative to each other.

Oven range appliance 10 also includes an insulated cabinet 12 with an interior cooking chamber 14 defined by an interior surface 15 of cabinet 12. Cooking chamber 14 is configured for the receipt of one or more food items to be cooked and extends between a top portion 30 and a bottom portion 32, e.g., along the vertical direction V. Oven range appliance 10 also includes a door 16 rotatably mounted to cabinet 12, e.g., with a hinge (not shown). A handle 18 is mounted to door 16 and assists a user with opening and closing door 16 in order to access cooking chamber 14. For example, a user can pull on handle 18 to open or close door 16 and access cooking chamber 14.

A seal (not shown) can be provided for maintaining heat and cooking fumes within cooking chamber 14 when door 16 is closed as shown in FIG. 2. Multiple parallel glass panes 22 provide for viewing the contents of cooking chamber 14 when door 16 is closed and to assist with insulating cooking chamber 14. A baking rack 24 is positioned in cooking chamber 14 for the receipt of food items or utensils containing food items. Baking rack 24 is slidably received onto embossed ribs or sliding rails 26 such that rack 24 may be conveniently moved into and out of cooking chamber 14 when door 16 is open.

A gas fueled, top heating element or broil gas burner 28 is positioned in cooking chamber 14 of cabinet 12, e.g., at or adjacent top portion 30 of cooking chamber 14. Broil gas burner 28 is used to heat cooking chamber 14 for both cooking/broiling and cleaning of oven range appliance 10. The size and heat output of broil gas burner 28 can be selected based on the e.g., the size of oven range appliance 10. In alternative embodiments, oven range appliance 10 can include an electric, gas, microwave, halogen, or any other suitable bake heating element positioned below broil gas burner 28 along the vertical direction V, e.g., at or adjacent bottom portion 32 of cooking chamber 14.

As may be seen in FIG. 2, a fuel system 35 (shown schematically) can supply gaseous fuel, such as natural gas or propane, to oven range appliance 10 and/or broil gas burner 28. Fuel system 35 includes a fuel supply 34. Fuel supply 34 can be any suitable mechanism for supplying or providing a volume of gaseous fuel. For example, fuel supply 34 can be a tank or a utility supply line.

Fuel system 35 also includes conduits or tubing 38 for directing gaseous fuel from fuel supply 34 to broil gas burner 28 and a valve 36 for regulating a flow of gaseous fuel through tubing 38. Valve 36 can selectively adjust between an open configuration and a closed configuration to selectively terminate or hinder the flow of gaseous fuel through tubing 38. Tubing 38 can supply gaseous fuel to broil gas burner 28, and such gaseous fuel can be combusted by broil gas burner 28, e.g., to heat cooking chamber 14.

FIG. 3 provides a bottom, perspective view of a broil gas burner assembly 100 according to an exemplary embodiment of the present subject matter. FIG. 4 provides a top, perspective view of broil gas burner assembly 100. Broil gas burner assembly 100 may be used in any suitable oven appliance, such as oven range appliance 10 as broil gas burner 28 (FIG. 2).

Broil gas burner assembly 100 includes a pair of burner tubes 110. Burner tubes 110 are spaced apart from each other, e.g., along the transverse direction T. Also, each burner tube of burner tubes 110 defines a series of laterally spaced apart ports 115. Ports 115 can direct a flow of air and gaseous fuel, such as natural gas and/or propane, out of burner tubes 110 where such air/fuel mixture can be combusted, e.g., to heat cooking chamber 14 (FIG. 2).

Burner tubes 110 include a first burner tube 112 and a second burner tube 114. Second burner tube 114 is positioned such that second burner tube 114 is spaced apart from first burner tube 112, e.g., along the transverse direction T. First and second burner tubes 112 and 114 can be spaced apart from each other by any suitable distance. For example, first and second burner tubes 112 and 114 can be spaced apart from each other along the transverse direction T by more than about six inches, more than about seven inches, or more than about eight inches. Further, first and second burner tubes 112 and 114 can be positioned such first and second burner tubes 112 and 114 are substantially parallel to each other. However, in alternative exemplary embodiments, first and second burner tubes 112 and 114 need not be parallel.

A flame spreader 136 is positioned above at least one of burner tubes 110, e.g., along the vertical direction V. Thus, flame spreader 136 is positioned above at least one of first burner tube 112 and second burner tube 114. In the exemplary embodiment shown in FIGS. 3 and 4, first and second burner tubes 112 and 114 are mounted to flame spreader 136. In particular, first and second burner tubes 112 and 114 are positioned at or on a bottom surface 138 of flame spreader 136, e.g., such that burner tubes 110 face bottom surface 138 of flame spreader 136.

Flame spreader 136 assists with distributing heat generated by broil gas burner assembly 100 via combustion of gaseous fuel. In particular, such combustion can heat flame spreader 136, and flame spreader 136 can direct radiant heat, e.g., into cooking chamber 14 (FIG. 2), as flame spreader 136 heats up due to such combustion. Flame spreader 136 can be constructed from any suitable material, such as a metal. As an example, flame spreader 136 can be constructed or formed from a sheet of steel.

First burner tube 112 extends between a first end portion 124 and a second end portion 126, e.g., along the lateral direction L. First burner tube 112 defines a series of outlets 116 spaced apart from one another or dispersed, e.g., along the lateral direction L, between first end portion 124 of first burner tube 112 and second end portion 126 of first burner tube 112. Like first burner tube 112, second burner tube 114 extends between a first end portion 128 and a second end portion 130, e.g., along the lateral direction L. Second burner tube 114 defines a series of exits 118 spaced apart from one another or dispersed, e.g., along the lateral direction L, between first end portion 128 of second burner tube 114 and second end portion 130 of second burner tube 114. Series of outlets and exits 116 and 118 (ports 115) can direct the flow of air and gaseous fuel out of first and second burner tubes 112 and 114, respectively, where such air/fuel mixture can be combusted, e.g., to heat cooking chamber 14 (FIG. 2).

Each burner tube of burner tubes 110 also includes a Venturi throat 140. Thus, first and second burner tubes 112 and 114 each include a respective Venturi throat 140. Venturi throat 140 of first burner tube 112 is positioned adjacent first end portion 124 of first burner tube 112. Similarly, Venturi throat 140 of second burner tube 114 is positioned adjacent first end portion 128 of second burner tube 114. As may be seen in FIG. 3, Venturi throats 140 have a smaller cross-sectional area than other portions of burner tubes 110. Thus, a flow of gaseous fuel and air flowing through Venturi throats 140 can increase in velocity and decrease in pressure thereby assisting with mixing of the gaseous fuel and air.

To light or ignite the flow of air/fuel exiting ports 115, broil gas burner assembly 100 also includes an igniter or ignition device 154 (FIG. 4), such as a spark ignition device or glow bar igniter. As an example, ignition device 154 can create a hot surface sufficient to ignite the flow of air/fuel exiting ports 115. Ignition device 154 can be located at any suitable position on broil gas burner assembly 100. As an example, ignition device 154 can be positioned adjacent or, e.g., above along the vertical direction V, first burner tube 112 or second burner tube 114. In particular, ignition device 154 can be mounted on or at a top surface 137 of flame spreader 136, e.g., at an aperture 139 defined by flame spreader 136 between top and bottom surfaces 137 and 138. To light broil gas burner assembly 100, gaseous fuel from ports 115 can flow through aperture 139, and ignition device 154 can light or ignite such gaseous fuel.

As discussed above, broil gas burner assembly 100 includes a single ignition device 154 that can be positioned adjacent first burner tube 112 or second burner tube 114, and first and second burner tubes 112 and 114 are spaced apart from each other. Broil gas burner assembly 100 also includes features to facilitate or assist lighting of both burner tubes of burner tubes 110. Such features can assist with distributing or carrying flame generated by ignition device 154 to all ports of ports 115 despite first and second burner tubes 112 and 114 being spaced apart from each other.

As may be seen in FIG. 3, broil gas burner assembly 100 includes a runner tube 156 that extends between and fluidly connects the burner tubes of burner tubes 110. In particular, runner tube 156 extends between first and second burner tubes 112 and 114, e.g., along the transverse direction T. As discussed in greater detail below, runner tube 156 can assist with carrying flames between the burner tubes of burner tubes 110.

FIG. 5 provides a side, elevation view of broil gas burner assembly 100. FIG. 6 provides a partial, perspective view of broil gas burner assembly 100. As may be seen in FIG. 5, runner tube 156 defines a series of transversely spaced apart openings 158. In particular, runner tube 156 defines openings 158 such that openings 158 are distributed, e.g., along the transverse direction T, between first and second burner tubes 112 and 114. Openings 158 are positioned adjacent or at outlets 116 of first burner tube 112 and exits 118 of second burner tube 114.

Gaseous fuel and air within burner tubes 110 can enter runner tube 156. In turn, such gaseous fuel and air can exit runner tube 156 through openings 158. At or outside of openings 158, such gaseous fuel can be combusted. By extending between and connecting first and second burner tubes 112 and 114, runner tube 156 can carry flames between first and second burner tubes 112 and 114. As an example, if ignition device 154 operates to ignite gaseous fuel exiting first burner tube 112 at outlets 116, outlets 116 can carry the flame of such combustion along the length of first burner tube 112 to runner tube 156. In turn, gaseous fuel exiting openings 158 of runner tube 156 at first burner tube 112 can be ignited, and openings 158 can carry the flame of such combustion along the length of runner tube 156 to second burner tube 114. In a similar manner to first burner tube 112, exits 118 can carry the flame of such combustion along the length of second burner tube 114. In such a manner, runner tube 156 can assist with lighting both burner tubes of burner tubes 110 despite only having a single ignition device 154 and burner tubes 110 being spaced apart from each other.

As may be seen in FIG. 6, runner tube 156 is positioned adjacent second end portions 126 and 130 of first and second burner tubes 112 and 114, respectively. Further turning back to FIG. 3, runner tube 156 and Venturi throats 140 are spaced apart from each other along the lateral direction L, e.g., such that runner tube 156 and Venturi throats 140 are positioned at opposite lateral ends of burner tubes 110. In particular, runner tube 156 is positioned between Venturi throat 140 and second end portions 126 and 130 of first and second burner tubes 112 and 114, respectively, along the lateral direction L. It should be understood that in alternative exemplary embodiments, runner tube 156 can be located at any suitable location on broil gas burner assembly 100. For example, runner tube 156 can be positioned adjacent first end portions 124 and 128 of first and second burner tubes 112 and 114, respectively.

Turning back to FIG. 5, broil gas burner assembly 100 includes a pair of orifices 142. Orifices 142 are configured for receiving gaseous fuel, e.g., from fuel source 34 via tubing 38 (FIG. 2), and directing such gaseous fuel into burner tubes 110. Each burner tube of burner tubes 110 defines an entrance or inlet 132 (FIG. 3). Each orifice of orifices 142 is positioned at a respective inlet 132 of burner tubes 110 and is configured for directing gaseous fuel into the respective inlet 132 of burner tubes 110.

In particular, orifices 142 include a first orifice 144 and a second orifice 146. Further, first burner tube 112 defines one inlet or inlets 132 at first end portion 124 of first burner tube 112, and second burner tube 114 defines another inlet of inlets 132 at first end portion 128 of second burner tube 114. First orifice 144 is positioned at or adjacent first end portion 124 of first burner tube 112 and is configured for directing gaseous fuel into inlet 132 of first burner tube 112. Similarly, second orifice 146 is positioned at first end portion 128 of second burner tube 114 and is configured for directing gaseous fuel into inlet 132 of second burner tube 114. Valve 36 (FIG. 2) can be utilized to selectively terminate or hinder the flow of gaseous fuel to first and second orifices 144 and 146 and burner tubes 110.

As may be seen in FIG. 6, each set of ports 115 includes a first set of ports 120 and a second set of ports 122. First and second sets of ports 120 and 122 are positioned on opposite transverse sides of each burner tube of burner tubes 110. Thus, first and second set of ports 120 and 122 are spaced apart from each other, e.g., along the transverse direction T, on each burner tube of burner tubes 110. By providing each burner tube of burner tubes 110 with first and second set of ports 120 and 122, burner tubes 110 can, e.g., provide more heat within cooking chamber 14 of oven range appliance 10 (FIG. 2) and/or more evenly heat food items within cooking chamber 14.

Each burner tube of burner tubes 110 also defines a set of carryover ports 160 that are distributed between first and second sets of ports 120 and 122. Thus, set of carryover ports 160 extends between first and second sets of ports 120 and 122 on each burner tube of burner tubes 110. Carryover ports 160 assist with carrying flame between first and second sets of ports 120 and 122. As an example, if ignition device 154 ignites gaseous fuel at first set of ports 120 then carryover ports 160 can carry the flame from such combustion to second set of ports 122, e.g., despite first and second sets of ports 120 and 122 being separated along the transverse direction T.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance defining a vertical direction, a lateral direction, and a transverse direction, the vertical, lateral, and transverse directions being mutually perpendicular, the oven appliance comprising:

a cabinet that defines a cooking chamber for receipt of food items for cooking, the cooking chamber of said cabinet extending between a top portion and a bottom portion along the vertical direction;

a broil gas burner assembly positioned at the top portion of the cooking chamber, said broil gas burner assembly comprising a first burner tube extending between a first end portion and a second end portion along the lateral direction, said first burner tube defining a series of outlets dispersed along the lateral direction between the first end portion of said first burner tube and the second end portion of said first burner tube, said first burner tube defining an inlet at the first end portion of said first burner tube;

a second burner tube spaced apart from said first burner tube along the transverse direction, said second burner tube extending between a first end portion and a second end portion along the lateral direction, said second burner tube defining a series of exits dispersed along the lateral direction between the first end portion of said second burner tube and the second end portion of said second burner tube, said second burner tube defining an entrance at the first end portion of said second burner tube;

a runner tube extending between said first burner tube and said second burner tube along the transverse direction, said runner tube defining a series of openings distributed along the transverse direction between said first and second burner tubes;

a first orifice positioned at the first end portion of said first burner tube and configured for directing fuel into the inlet of said first burner tube;

a second orifice positioned at the first end portion of said second burner tube and configured for directing fuel into the entrance of said second burner tube;

a valve; and tubing extending between and connecting said valve and said first and second orifices such that said first orifice directs gaseous fuel into said first burner tube and said second orifice directs gaseous fuel into said second burner tube when said valve is in an open configuration and said first orifice does not direct gaseous fuel into said first burner tube and said second orifice does not direct gaseous fuel into said second burner tube when said valve is in a closed configuration.

2. The oven appliance of claim 1, wherein said first and second burner tubes are spaced apart from each other along the transverse direction by more than about six inches.

3. The oven appliance of claim 1, wherein said first and second burner tubes are substantially parallel to each other.

4. The oven appliance of claim 1, further comprising an ignition device positioned adjacent said first burner tube, said second burner tube, or said runner tube.

5. The oven appliance of claim 1, wherein the outlets of said first burner tube includes a first set of outlets and a second set of outlets, the first and second sets of outlets positioned on opposite transverse sides of said first burner tube, said first burner tube further defining a set of carryover outlets that are distributed between the first and second sets of outlets.

6. The oven appliance of claim 1, further comprising a flame spreader positioned above at least one of said first burner tube and said second burner tube along the vertical direction.

7. The oven appliance of claim 1, wherein said first and second burner tubes each include a respective Venturi throat, the Venturi throat of said first burner tube positioned adjacent the first end portion of said first burner tube, the Venturi throat of said second burner tube positioned adjacent the first end portion of said second burner tube, said runner tube positioned between the Venturi throats of said first and second burner tubes and the second end portions of said first and second burner tubes along the lateral direction.

8. The oven appliance of claim 1, wherein one of the openings of said runner tube is positioned proximate the series of outlets of said first burner tube, another one of the openings of said runner tube positioned proximate the series of exits of said second burner tube.

9. The oven appliance of claim 1, wherein said runner tube is positioned adjacent the second end portions of said first and second burner tubes.

10. An oven appliance defining a vertical direction, a lateral direction, and a transverse direction, the vertical, lateral, and transverse directions being mutually perpendicular, the oven appliance comprising:

a cabinet that defines a cooking chamber for receipt of food items for cooking, the cooking chamber of said cabinet extending between a top portion and a bottom portion along the vertical direction;

a pair of burner tubes positioned at the top portion of the cooking chamber, the burner tubes of said pair of burner tubes spaced apart from each other along the transverse direction, each burner tube of said pair of burner tubes defining a series of laterally spaced apart flame ports;

a runner tube extending between and fluidly connecting the burner tubes of said pair of burner tubes, said runner tube defining a series of transversely spaced apart openings, said runner tube configured for carrying flames between the burner tubes of said pair of burner tubes, each burner tube of said pair of burner tubes defining an inlet;

a pair of orifices, each orifice of said pair of orifices positioned at a respective inlet of said pair of burner tubes and configured for directing fuel into the respective inlet of said pair of burner tubes;

a valve; and tubing extending between and connecting said valve and said pair of orifices such that said valve regulates a flow of fuel to both burner tubes of said pair of burner tubes via said pair of orifices.

11. The oven appliance of claim 10, wherein the burner tubes of said pair of burner tubes are spaced apart from each other along the transverse direction by more than about six inches.

12. The oven appliance of claim 10, wherein the burner tubes of said pair of burner tubes are substantially parallel to each other.

13. The oven appliance of claim 10, further comprising an ignition device positioned adjacent one of said pair of burner tubes or said runner tube.

14. The oven appliance of claim 10, wherein the series of laterally spaced apart flame ports includes a first set of flame ports and a second set of flame ports, the first and second sets of flame ports positioned on opposite transverse sides of the burner tubes of said pair of burner tubes, each burner tube of said pair burner tubes further defining a set of carryover flame ports that are distributed between the first and second sets of flame ports.

15. The oven appliance of claim 10, wherein each burner tube of said pair of burner tubes include a Venturi throat, said runner tube and the Venturi throats positioned at opposite lateral ends of said pair of burner tubes.

16. A gas burner assembly for an oven appliance, the gas burner assembly defining a vertical direction, a lateral direction, and a transverse direction, the vertical, lateral, and transverse directions being mutually perpendicular, the gas burner assembly comprising:

a pair of burner tubes spaced apart from each other along the transverse direction, each burner tube of said pair of burner tubes defining a series of laterally spaced apart flame ports, each burner tube of said pair of burner tubes also defining an inlet;

a pair of orifices, each orifice of said pair of orifices positioned at a respective inlet of said pair of burner tubes and configured for directing a flow of gaseous fuel into the respective inlet of said pair of burner tubes;

a single valve configured for regulating the flow of gaseous fuel to said pair of orifices, the single valve permitting gaseous fuel flow into both burner tubes of said pair of burner tubes in an open configuration and blocking gaseous fuel flow into both burner tubes of said pair of burner tubes in a closed configuration; and a runner tube extending between and fluidly connecting the burner tubes of said pair of burner tubes, said runner tube defining a series of transversely spaced apart openings, said runner tube configured for carrying flames between the burner tubes of said pair of burner tubes.

* * * * *